US012595921B2

(12) United States Patent
Shirai et al.

(10) Patent No.: US 12,595,921 B2
(45) Date of Patent: Apr. 7, 2026

(54) SPACE PURIFICATION DEVICE

(71) Applicant: Panasonic Intellectual Property Management Co., Ltd., Osaka (JP)

(72) Inventors: Ikuma Shirai, Aichi (JP); Yuki Mizuno, Aichi (JP); Shinji Yoshida, Aichi (JP); Tomohiro Hayashi, Aichi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 441 days.

(21) Appl. No.: 18/550,236

(22) PCT Filed: Feb. 24, 2022

(86) PCT No.: PCT/JP2022/007478
§ 371 (c)(1),
(2) Date: Sep. 12, 2023

(87) PCT Pub. No.: WO2022/209447
PCT Pub. Date: Oct. 6, 2022

(65) Prior Publication Data

US 2024/0151412 A1 May 9, 2024

(30) Foreign Application Priority Data

Mar. 30, 2021 (JP) ..... 2021-056461

(51) Int. Cl.

| | |
|---|---|
| ***F24F 8/24*** | (2021.01) |
| ***F24F 6/14*** | (2006.01) |
| ***F24F 6/16*** | (2006.01) |
| ***F24F 8/15*** | (2021.01) |
| ***F24F 8/80*** | (2021.01) |
| ***F24F 8/95*** | (2021.01) |

(52) U.S. Cl.
CPC ..... *F24F 8/24* (2021.01); *F24F 6/16* (2013.01); *F24F 8/15* (2021.01); *F24F 8/80* (2021.01); *F24F 8/95* (2021.01); *F24F 2006/146* (2013.01)

(58) Field of Classification Search
CPC ..... F24F 8/24; F24F 8/15; F24F 8/95; F24F 8/80; F24F 6/16; F24F 2006/146
See application file for complete search history.

(56) References Cited

FOREIGN PATENT DOCUMENTS

| | | | |
|---|---|---|---|
| JP | H07-290057 | A | 11/1995 |
| JP | H09-290267 | A | 11/1997 |
| JP | 2008-183185 | A | 8/2008 |
| JP | 2009-133521 | A | 6/2009 |
| WO | 2020/158850 | A1 | 8/2020 |

OTHER PUBLICATIONS

International Search Report issued on May 10, 2022 in International Patent Application No. PCT/JP2022/007478, with English translation.

*Primary Examiner* — Sean E Conley
(74) *Attorney, Agent, or Firm* — Rimon P.C.

(57) ABSTRACT

Space purification device according to the present disclosure includes hypochlorous acid water generator, mixing bath, hypochlorous acid water supply unit, water supply unit, humidifying purification unit, and control unit. Control unit is configured to, after a humidifying purification operation using the mixture water has finished, perform a first washing operation of causing water supply unit to supply water to electrolytic bath and of causing hypochlorous acid water supply unit to supply water stored in electrolytic bath to mixing bath, without performing the electrolyzing.

4 Claims, 3 Drawing Sheets

SPACE PURIFICATION DEVICE

CROSS-REFERENCE OF RELATED APPLICATIONS

This application is the U.S. National Phase under 35 U.S.C. § 371 of International Patent Application No. PCT/JP2022/007478, filed on Feb. 24, 2022, which in turn claims the benefit of Japanese Patent Application No. 2021-056461, filed on Mar. 30, 2021, the entire disclosures of which Applications are incorporated by reference herein.

TECHNICAL FIELD

The present disclosure relates to a space purification device that micronizes water, suctions the air, blows out the suctioned air containing the micronized water, and releases the micronized water containing a purification component.

BACKGROUND ART

As a conventional space purification device, there is a known air conditioning system that causes the air to be supplied indoors into contact with a gas-liquid contact member containing a purification component (reactive oxygen species such as hypochlorous acid) and then releases the air, to sterilize the space where the air is supplied (see, for example, PTL 1).

In a conventional space purification device, an aqueous solution containing hypochlorous acid (hypochlorous acid water) is generated through the electrolysis of brine.

CITATION LIST

Patent Literature

PTL 1: Unexamined Japanese Patent Publication No. 2009-133521

SUMMARY OF THE INVENTION

However, in the conventional space purification device, hypochlorous acid water remaining inside may dry while the device is not operating, and the component (e.g., sodium chloride) contained in the hypochlorous acid water may become deposited. There is a concern that, as the device is put into operation and stopped repeatedly, such deposits may become accumulated and clog a pipe, for example.

The present disclosure provides a space purification device capable of suppressing clogging inside of the device when the device is used continuously over a long time period.

A space purification device according to the present disclosure includes: a hypochlorous acid water generator including (i) an electrolytic bath that stores a sodium chloride solution, and (ii) an electrode that is energized to electrolyze the sodium chloride solution to generate hypochlorous acid water; a mixing bath storing mixture water of the hypochlorous acid water and water; a hypochlorous acid water supply unit supplying the hypochlorous acid water from the hypochlorous acid water generator to the mixing bath; a water supply unit supplying the water to the electrolytic bath or to the mixing bath; a humidifying purification unit that micronizes the mixture water and to release the mixture water micronized into air, by performing a humidifying purification operation using the mixture water stored in the mixing bath; and a control unit controlling the hypochlorous acid water generator, the hypochlorous acid water supply unit, the water supply unit, and the humidifying purification unit. The control unit is configured to, after the humidifying purification operation using the mixture water has finished, perform a first washing operation of causing the water supply unit to supply the water to the electrolytic bath and causing the hypochlorous acid water supply unit to supply the water stored in the electrolytic bath to the mixing bath without performing the electrolyzing.

According to the present disclosure, it is possible to provide a space purification device capable of suppressing clogging inside of the device when the device is used continuously over a long time period.

DESCRIPTION OF EMBODIMENT

Figure 1:
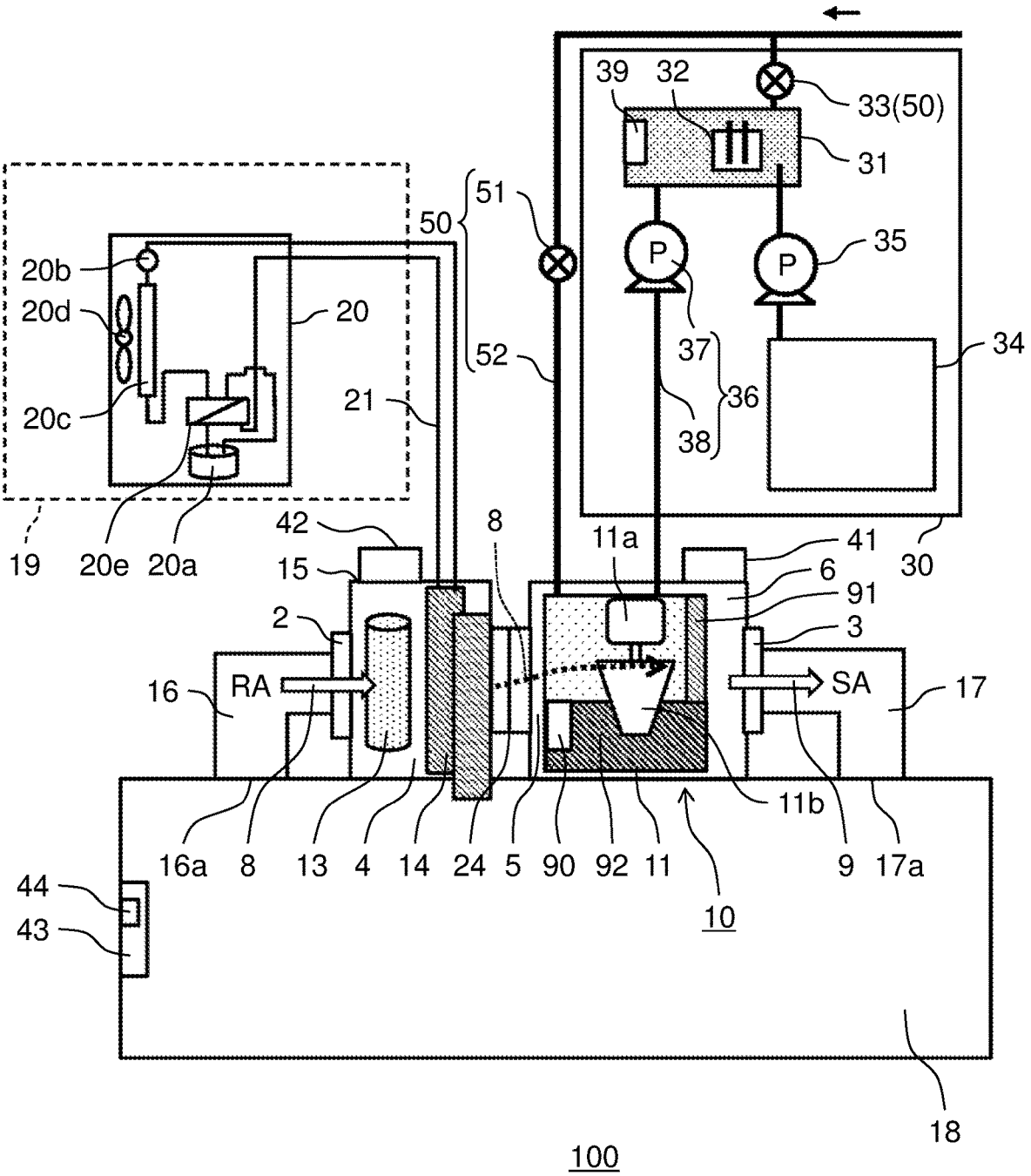
FIG. 1 is a diagram illustrating a configuration of a space purification system including a space purification device according to a first embodiment of the present disclosure.

A space purification device according to the present disclosure includes: a hypochlorous acid water generator including (i) an electrolytic bath that stores a sodium chloride solution, and (ii) an electrode that is energized to electrolyze the sodium chloride solution to generate hypochlorous acid water; a mixing bath storing mixture water of the hypochlorous acid water and water; a hypochlorous acid water supply unit supplying the hypochlorous acid water from the hypochlorous acid water generator to the mixing bath; a water supply unit supplying the water to the electrolytic bath or to the mixing bath; a humidifying purification unit that micronizes the mixture water and to release the mixture water micronized into air, by performing a humidifying purification operation using the mixture water stored in the mixing bath; and a control unit controlling the hypochlorous acid water generator, the hypochlorous acid water supply unit, the water supply unit, and the humidifying purification unit. The control unit is configured to, after the humidifying purification operation using the mixture water has finished, perform a first washing operation of causing the water supply unit to supply the water to the electrolytic bath and causing the hypochlorous acid water supply unit to supply the water stored in the electrolytic bath to the mixing bath without performing the electrolyzing.

With such a configuration, in the first washing operation, the members including a circulation passage extending from the electrolytic bath to the mixing bath are washed with the water stored in the electrolytic bath, so that the deposited component (e.g., sodium chloride) derived from the hypochlorous acid water can be removed. Therefore, in the space purification device, it is possible to suppress clogging inside of the device even when the device is used continuously over a long time period.

Furthermore, in the space purification device according to the present disclosure, the control unit may be configured to cause the water supply unit to supply the water to the mixing bath after the first washing operation has finished, and to perform a second washing operation of performing the humidifying purification operation using the water stored in the mixing bath. In this manner, in the second washing operation, the internal of the humidifying purification unit (e.g., eliminator) is washed with the water stored in the mixing bath, and the deposited component (e.g., sodium chloride) derived from the hypochlorous acid water can be removed. Therefore, in the space purification device, it is possible to suppress clogging inside of the device more, even when the device is used continuously over a long time period.

Furthermore, in the space purification device according to the present disclosure, the control unit may be configured to, after the hypochlorous acid water generator has finished supplying the hypochlorous acid water to the mixing bath, control the water supply unit to supply the water to the electrolytic bath, and to store the water in the electrolytic bath in advance, in the first washing operation. As a result, in the electrolytic bath, after the electrolytic bath finishes supplying the hypochlorous acid water into the mixing bath, the electrode of the electrolytic bath is kept immersed in the water. Therefore, it is possible to inhibit a local corrosion of a part of the electrolytic bath including the electrode, caused by concentration of the component included in the hypochlorous acid water, which takes place as the hypochlorous acid water becomes dry while the electrolytic bath is left empty, with the hypochlorous acid water slightly remaining on the surface of such a part of the electrolytic bath including the electrode.

Furthermore, in the space purification device according to the present disclosure, the control unit is configured to end the humidifying purification operation every time a predetermined period elapses. In this manner, the washing operation (the first washing operation or the second washing operation) is performed regularly, so that the clogging inside of the device can be suppressed reliably, even when the device is used continuously over a long time period.

An exemplary embodiment of the present disclosure will now be explained with reference to the accompanying drawings. Note that the exemplary embodiment described below describes a preferred specific example of the present disclosure. Thus, the numerical values, shapes, materials, components, arrangement positions and connection forms of the components, and the like shown in the following exemplary embodiment are examples, and are not intended to limit the present disclosure. Among the constituent elements in the following exemplary embodiments, those not described in independent claims, which are the descriptions of the most abstract concept of the present disclosure, are described as optional constituent elements. In addition, in the drawings, substantially the same components are denoted by the same reference marks, and redundant descriptions thereof will be omitted or simplified.

First Exemplary Embodiment

FIG. 1 is a diagram illustrating a configuration of space purification system 100 including space purification device 10 according to a first embodiment of the present disclosure. Space purification system 100 is a device that performs cooling process (dehumidifying process) or heating process to air 8 (RA) in indoor space 18, as required, while circulating the air from indoor space 18, and adds a component for purifying the air (hereinafter, also simply referred to as "air purification component"), as well as micronized water, to air 8 being circulated therethrough. Space purification system 100 sterilizes and deodorizes indoor space 18 by supplying air 9 (SA) being circulated therethrough to indoor space 18. In the example explained herein, hypochlorous acid is used as the air purification component, and the water containing the air purification component is an aqueous solution of the hypochlorous acid (hypochlorous acid water).

As illustrated in FIG. 1, space purification system 100 is mainly configured by including space purification device 10, air conditioner 15, and hypochlorous acid water generator 30.

Space purification device 10 includes air outlet 3, air purifier 11, and air purification control unit 41. Air conditioner 15 includes air inlet 2, air blower 13, refrigeration coil 14, and air conditioning control unit 42. Each of space purification device 10 and air conditioner 15 has a housing configuring an outer frame of the corresponding device, and space purification device 10 and air conditioner 15 are connected via duct 24. In addition, air inlet 2 is provided on a side surface of air conditioner 15, and air outlet 3 is provided on a side surface of space purification device 10.

Air inlet 2 is an intake port for introducing air 8 from indoor space 18 into air conditioner 15. Air inlet 2 is connected communicably with indoor air inlet 16*a* provided on a ceiling or the like of indoor space 18, via duct 16. In this manner, air inlet 2 can suck the air from indoor space 18 into air conditioner 15 via indoor air inlet 16*a*.

Air outlet 3 is a discharge port via which air 9 (SA) circulated through space purification device 10 is discharged to indoor space 18. Air outlet 3 is connected communicably with indoor air outlet 17*a* provided on the ceiling or the like of indoor space 18 via duct 17. As a result, air outlet 3 can blow out air 9 having passed through space purification device 10 toward indoor space 18, via indoor air outlet 17*a*.

Inside air conditioner 15 and space purification device 10, an air passage (prior stage air passage 4, middle stage air passage 5, and subsequent stage air passage 6) communicably connecting air inlet 2 and air outlet 3 via duct 24 is formed. Prior stage air passage 4 is an air passage adjacent to air inlet 2. Air blower 13 and refrigeration coil 14 are provided in prior stage air passage 4.

Middle stage air passage 5 is an air passage through which air 8 having passed through prior stage air passage 4 flows, at a position adjacent to prior stage air passage 4 (duct 24). Air purifier 11 is provided inside middle stage air passage 5.

Subsequent stage air passage 6 is an air passage adjacent to air outlet 3. In subsequent stage air passage 6, air 8 having passed through middle stage air passage 5 circulates through air purifier 11, and turns into air 9 containing hypochlorous acid as well as the micronized water.

In air conditioner 15 and space purification device 10, air 8 suctioned through air inlet 2 passes through prior stage air passage 4, passes through middle stage air passage 5 and subsequent stage air passage 6, and is blown out of air outlet 3, as air 9.

Air blower 13 in air conditioner 15 is a device for conveying air 8 (RA) in indoor space 18 into air conditioner 15 via air inlet 2. Air blower 13 is installed upstream of refrigeration coil 14, inside prior stage air passage 4. The operation of air blower 13 is controlled to switch on/off based on blower output information from air conditioning control unit 42. When air blower 13 is operated, air 8 in indoor space 18 is collected to air conditioner 15, and flows toward refrigeration coil 14.

Refrigeration coil 14 is a member disposed downstream of air blower 13 inside prior stage air passage 4, and cools or heats air 8 introduced thereto. Refrigeration coil 14 changes an output state (cooling, heating, or off) depending on an output signal from air conditioning control unit 42, and adjusts the cooling capacity (cooling amount) or the heating capacity (heating amount) of air 8 introduced thereto. When refrigeration coil 14 cools introduced air 8, air 8 is dehumidified. Therefore, the cooling capacity (cooling amount) for air 8 can also be considered as the dehumidifying capacity (dehumidifying amount) for air 8.

Refrigeration coil 14 functions as a heat absorber or a radiator in a refrigeration cycle including a compressor, a radiator, an expander, and a heat absorber, and is configured to absorb heat (cool) or radiate heat (heat) when the refrigerant introduced from outdoor unit 20 circulates therethrough. More specifically, refrigeration coil 14 is connected to outdoor unit 20 via refrigerant circuit 21 through which a refrigerant circulates. Outdoor unit 20 is an outdoor unit installed in outdoor space 19, and includes compressor 20*a*, expander 20*b*, outdoor heat exchanger 20*c*, blower fan 20*d*, and four-way valve 20*e*. Since outdoor unit 20 having a general configuration is used, detailed descriptions of these devices (compressor 20*a*, expander 20*b*, outdoor heat exchanger 20*c*, blower fan 20*d*, and four-way valve 20*e*) are omitted herein.

Because four-way valve 20*e* is connected to the refrigeration cycle including refrigeration coil 14, air conditioner 15 can be switched between a cooling mode (dehumidifying mode) in which four-way valve 20*e* passes the refrigerant in a first direction to cool and to dehumidify the air (air 8) and a heating mode in which four-way valve 20*e* passes the refrigerant in a second direction to heat the air (air 8).

The first direction herein is a direction in which the refrigerant circulates through compressor 20*a*, outdoor heat exchanger 20*c*, expander 20*b*, and refrigeration coil 14 in the order listed herein. The second direction herein is a direction in which the refrigerant circulates through compressor 20*a*, refrigeration coil 14, expander 20*b*, and outdoor heat exchanger 20*c* in the order listed herein. Refrigeration coil 14 can cool or heat the air introduced thereto (air 8).

Air purifier 11 in space purification device 10 is a unit for humidifying air 8 collected therein, and adds hypochlorous acid as well as micronized water to the air during the humidification. More specifically, air purifier 11 includes water level sensor 90, eliminator 91, mixing bath 92, humidification motor 11*a*, and humidification nozzle 11*b*.

Air purifier 11 has a centrifugal crushing type configuration in which humidification nozzle 11*b* is rotated using humidification motor 11*a*, so that a centrifugal force causes the water (hypochlorous acid water) stored in mixing bath 92 in air purifier 11 to be suctioned, scattered, collide with, and be crushed against the periphery (centrifugal direction), so that moisture is added to the air passing therethrough. Air purifier 11 adjusts the humidification capacity (humidification amount) by changing the rotation speed (hereinafter, the rotation output value) of humidification motor 11*a*, in accordance with an output signal from air purification control unit 41. The humidification amount can also be said to be the amount by which the hypochlorous acid is added to the air. Air purifier 11 corresponds to a "humidifying purification unit" as mentioned in the claims.

Water level sensor 90 measures the water level of hypochlorous acid water (mixture water) in mixing bath 92, and outputs the measurement value to air purification control unit 41.

Eliminator 91, which is a porous body through which the air is allowed to pass, is provided on one side of air purifier 11 (on the side of air outlet 3 in the centrifugal direction), and is disposed so that air is passed in the centrifugal direction. Eliminator 91 micronizes water droplets discharged from the humidification nozzle 11*b*, by causing the droplets to collide therewith, and collects large water droplets from the water in the air passing through air purifier 11. As a result, the air passed through air purifier 11 contains only vaporized water.

Mixing bath 92 is a bath in which hypochlorous acid water is stored in air purifier 11, and may also be said to be a water storage unit. In mixing bath 92, hypochlorous acid water having a predetermined concentration supplied from hypochlorous acid water generator 30 (electrolytic bath 31) by a hypochlorous acid water supply unit 36, which is to be described later, and water supplied from water supply unit 50, which is to be described later, are mixed in the bath and stored as mixture water that is diluted hypochlorous acid water.

Hypochlorous acid water generator 30 includes electrolytic bath 31, electrode 32, electromagnetic valve 33, brine tank 34, brine conveyance pump 35, water level sensor 39, and hypochlorous acid water supply unit 36.

Electromagnetic valve 33 controls whether to or not to supply tap water from a water feed pipe (water delivery pipe 52, which is to be described later) such as water service line, to electrolytic bath 31, in accordance with an output signal from air purification control unit 41. Electromagnetic valve 33 configures water supply unit 50, which is to be described later.

Brine tank 34 is a container in which a liquid including chloride ions (brine) is stored. Brine conveyance pump 35 supplies brine in brine tank 34 to electrolytic bath 31, in accordance with an output signal from air purification control unit 41.

Electrolytic bath 31 stores the brine to be electrolyzed, supplied from brine tank 34. Tap water is also supplied to electrolytic bath 31 from a water feed pipe (water delivery pipe 52) such as water service line, via electromagnetic valve 33, in accordance with an output signal from air purification control unit 41, and the supplied tap water and brine are mixed, and brine having a predetermined concentration is stored in electrolytic bath 31.

Electrode 32 includes a pair of electrodes. Electrode 32 is disposed in electrolytic bath 31, and energized, in accordance with an output signal from air purification control unit 41, to cause electrolysis of the brine for a predetermined time so as to generate hypochlorous acid water having a predetermined concentration.

In other words, hypochlorous acid water is generated by causing electrolysis of a chloride solution (e.g., sodium chloride solution) as an electrolyte, between the pair of electrodes, in electrolytic bath 31. Because a generally available device is used as electrolytic bath 31, a detailed description thereof will be omitted. The electrolyte is an electrolyte capable of generating hypochlorous acid water, and is not limited to any particular electrolyte, as long as the electrolyte contains chloride ions even in a small amount, and examples thereof include a solution in which sodium chloride, calcium chloride, or magnesium chloride is dissolved as a solute. Hydrochloric acid is also acceptable. In the present exemplary embodiment, a sodium chloride solution (brine) obtained by adding sodium chloride to water is used as the electrolyte.

Water level sensor 39 measures the water level in electrolytic bath 31, and outputs the measurement value to air purification control unit 41.

Hypochlorous acid water supply unit 36 supplies the hypochlorous acid water from electrolytic bath 31 into mixing bath 92 in air purifier 11, in accordance with an output signal from air purification control unit 41. Hypochlorous acid water supply unit 36 includes hypochlorous acid water conveyance pump 37 and water delivery pipe 38.

Hypochlorous acid water conveyance pump 37 sends the hypochlorous acid water in electrolytic bath 31 to the water delivery pipe 38, in accordance with an output signal from air purification control unit 41. Water delivery pipe 38 is connected between hypochlorous acid water conveyance pump 37 and mixing bath 92, and delivers the hypochlorous acid water to mixing bath 92.

Water supply unit 50 supplies the water to mixing bath 92, in accordance with an output signal from air purification control unit 41. Water supply unit 50 includes electromagnetic valve 51 and water delivery pipe 52. Water supply unit 50 also includes electromagnetic valve 33 described above. Electromagnetic valve 51 controls to switch to feed or not to feed the water supplied from a water pipe external of space purification device 10 to water delivery pipe 52, in accordance with an output signal from air purification control unit 41. Water delivery pipe 52 is connected between electromagnetic valve 51 and mixing bath 92, and delivers the water to mixing bath 92.

In air purifier 11, each of the hypochlorous acid water from hypochlorous acid water supply unit 36 and the water from water supply unit 50 is supplied to mixing bath 92. Hypochlorous acid water and water are then mixed in mixing bath 92 of air purifier 11. In other words, the hypochlorous acid water is mixed and diluted with water from water supply unit 50, in mixing bath 92. The mixture water of hypochlorous acid water and water may also be said to be hypochlorous acid water. More specifically, in mixing bath 92 of air purifier 11, hypochlorous acid water from hypochlorous acid water supply unit 36 or water from water supply unit 50 is supplied to and mixed with hypochlorous acid water remaining in mixing bath 92. Air purifier 11 releases the air containing the hypochlorous acid water to indoor space 18, by centrifugally crushing the mixture water of the hypochlorous acid water and water stored in mixing bath 92. The micronized hypochlorous acid water, with the liquid component evaporated, is released to indoor space 18.

Operation device 43 is installed on a wall surface of indoor space 18. Operation device 43 includes a user interface that is operable by a user, and receives a temperature setting value, a humidity setting value, and information related to the humidifying purification operation, from the user. Operation device 43 includes temperature and humidity sensor 44. Temperature and humidity sensor 44 measures the temperature and humidity of the air in indoor space 18. Any known technology may be used in temperature and humidity sensor 44 to measure the temperature and humidity, and therefore, a description thereof is omitted herein.

Operation device 43 is connected to air purification control unit 41 and air conditioning control unit 42 over the wire or wirelessly, and transmits information related to the humidifying purification operation to air purification control unit 41 and air conditioning control unit 42, in addition to information related to a temperature setting value, a humidity setting value, a temperature measurement value, and a humidity measurement value. These pieces of information may be sent all together, or any two or more of these pieces may be sent together, or may be sent separately. It is also possible for operation device 43 to transmit these pieces of information to air purification control unit 41, and to cause air purification control unit 41 to transfer the information to air conditioning control unit 42.

Air conditioning control unit 42 in air conditioner 15 receives a temperature setting value and a temperature measurement value, and controls refrigeration coil 14 and outdoor unit 20 so as to bring the temperature measurement value closer to the temperature setting value. In the heating mode, when the measured temperature value is below the temperature setting value and the difference between the temperature measurement value and the temperature setting value becomes greater, air conditioning control unit 42 heats by a larger degree.

Air purification control unit 41 in space purification device 10 will now be explained.

As the processing operations of hypochlorous acid water generator 30 and space purification device 10, air purification control unit 41 controls an operation related to an electrolysis process in electrolytic bath 31, an operation related to a process of supplying hypochlorous acid water to air purifier 11, an operation related to a process of suppling water to air purifier 11, and an operation related to a humidifying purification process in air purifier 11. Note that air purification control unit 41 includes a computer system including a processor and a memory. The computer system functions as a controller by causing the processor to execute a program stored in the memory. In the example explained herein, the program executed by the processor is recorded in the memory of the computer system in advance, but may be provided in a manner recorded in a non-transitory recording medium, such as a memory card, or provided over a telecommunication line such as the Internet. Air purification control unit 41 corresponds to a "control unit" as mentioned the claims.

Figure 2:
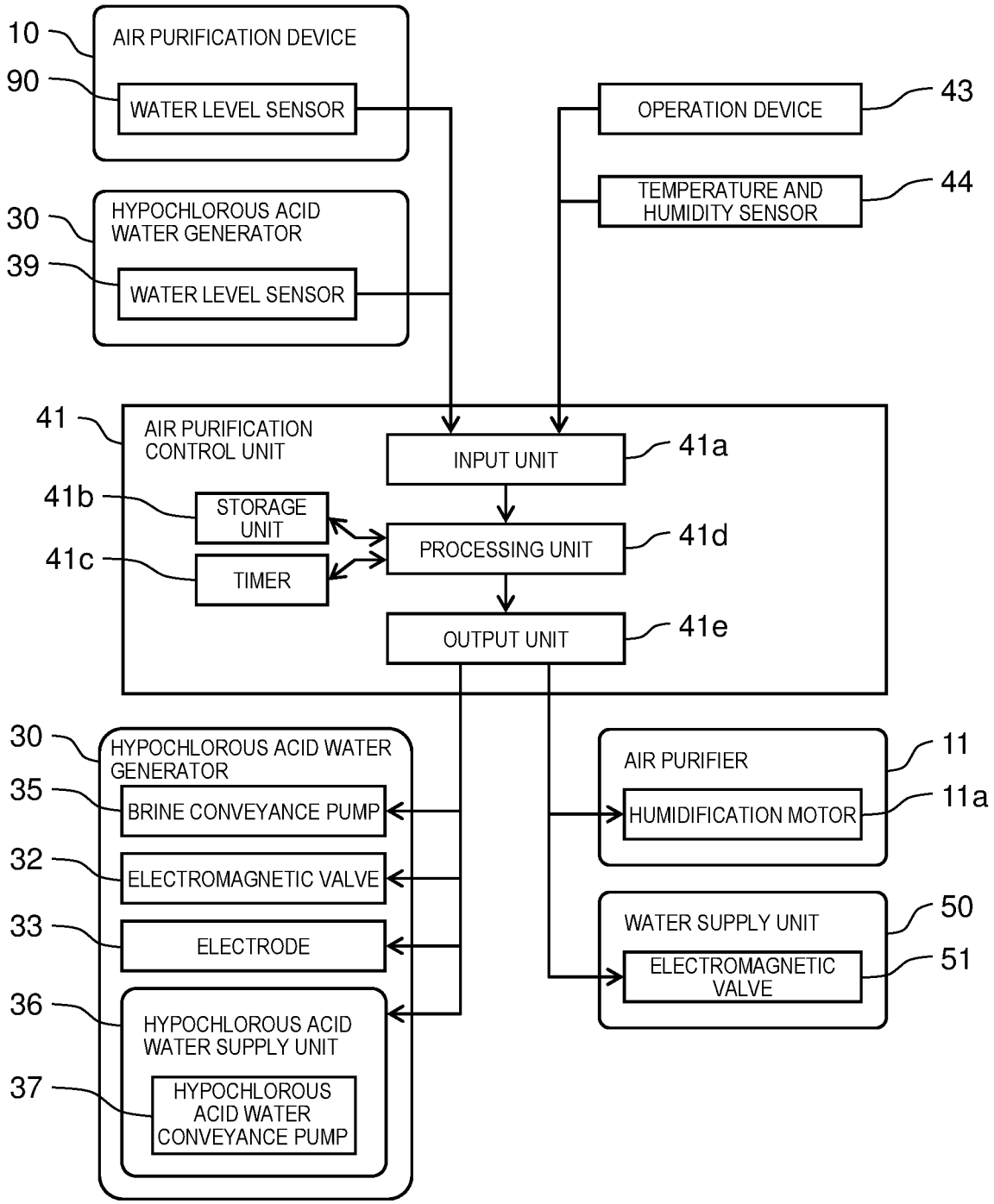
FIG. 2 is a block diagram illustrating a configuration of a control unit of the space purification device according to the first exemplary embodiment.

Specifically, as illustrated in FIG. 2, air purification control unit 41 includes input unit 41*a*, storage unit 41*b*, timer 41*c*, processing unit 41*d*, and output unit 41*e*.

<Operation Related to Electrolysis Process in Electrolytic Bath>

Air purification control unit 41 performs the following process, as an operation related to the electrolysis process in electrolytic bath 31.

Air purification control unit 41 receives water level information (water-shortage signal) from water level sensor 39 and information related to time (time information) from timer 41*c*, as a trigger for the electrolysis process in electrolytic bath 31, and outputs the received information to processing unit 41*d*.

Processing unit 41*d* identifies the control information based on the water level information from water level sensor 39, the time information from timer 41*c*, and the setting information from storage unit 41*b*, and outputs the identified control information to output unit 41*e*. At this time, the setting information includes information of the time at which generation of hypochlorous acid water is started or ended, information of the amount of tap water to be supplied to electrolytic bath 31, information of the amount of brine to be input by brine conveyance pump 35, information on the conditions of electrolysis (such as time, current value, voltage) for electrode 32, information of the timing at which electromagnetic valve 33 is opened and closed, and information related to on/off operation of hypochlorous acid water conveyance pump 37.

The conditions under which electrode 32 performs the electrolysis may be determined based on the amount of tap water in electrolytic bath 31, the concentration of chloride ions, the time of electrolysis, and a degree by which electrode 32 has become deteriorated. The conditions are set by creating an algorithm, and stored in storage unit 41*b*.

Then, based on the received control information, output unit 41*e* outputs a signal (control signal) to each of the devices (brine conveyance pump 35, electromagnetic valve 33, and hypochlorous acid water conveyance pump 37).

More specifically, to begin with, brine conveyance pump 35 is kept not operating based on the signal from output unit 41*e*, and hypochlorous acid water conveyance pump 37 is kept not operating based on the signal from output unit 41*e*.

Electromagnetic valve 33 is then opened, based on a signal from output unit 41*e*. The tap water from the water pipe then starts being supplied to electrolytic bath 31. Electromagnetic valve 33 is then closed, based on a signal from output unit 41*e* having received the water level information (water full) from water level sensor 39. In this manner, electrolytic bath 31 is filled with tap water with a set amount of supply.

Brine conveyance pump 35 then is caused to start operating, based on a signal from output unit 41*e*, to convey a predetermined amount of brine to electrolytic bath 31, and stops the operation. As a result, chloride ions are allowed to dissolve in the tap water, and electrolytic bath 31 comes to hold an aqueous solution (chloride solution) having been generated to contain a predetermined amount of chloride ions.

Electrode 32 then starts the electrolysis of the chloride solution based on a signal from output unit 41*e*, to generate the hypochlorous acid water under set conditions, and stops the electrolysis. The hypochlorous acid water generated by electrode 32 has a hypochlorous acid concentration of 100 ppm to 150 ppm (e.g., 120 ppm) and pH of 7 to 8.5 (e.g., 8.0), for example.

As described above, air purification control unit 41 executes the electrolysis process in electrolytic bath 31, and a predetermined amount of hypochlorous acid water having a predetermined concentration is generated.

<Operation Related to Process of Supplying Hypochlorous Acid Water to Air Purifier>

Air purification control unit 41 performs the following process as an operation related to the process of supplying the hypochlorous acid water to air purifier 11.

Air purification control unit 41 causes timer 41*c* to measure the time for which humidification motor 11*a* is in operation, as a trigger for the process of supplying the hypochlorous acid water to air purifier 11. Every time a predetermined operation time (e.g., 60 minutes) elapses, air purification control unit 41 outputs a request for supplying the hypochlorous acid water to hypochlorous acid water generator 30 (hypochlorous acid water supply unit 36). The predetermined time herein is a time estimated in advance through experimental evaluations, given the fact that hypochlorous acid in hypochlorous acid water vaporizes and decreases over time.

Specifically, processing unit 41*d* identifies control information based on the information (time information) related to the time from timer 41*c* and the setting information from storage unit 41*b*, and outputs the identified control information to output unit 41*e*. In the example herein, the setting information includes information related to an interval (e.g., 60 minutes) at which the hypochlorous acid water is supplied, and information related to on/off operations of hypochlorous acid water conveyance pump 37.

Output unit 41*e* then outputs a signal (control signal) to hypochlorous acid water conveyance pump 37 included in hypochlorous acid water supply unit 36, based on the received control information.

Hypochlorous acid water conveyance pump 37 is caused to operate based on a signal from output unit 41*e*. As a result, hypochlorous acid water generator 30 is caused to start supplying the hypochlorous acid water from electrolytic bath 31 to air purifier 11 (mixing bath 92). In order to ensure the concentration of hypochlorous acid water stored in electrolytic bath 31, the entire amount of hypochlorous acid water generated in electrolytic bath 31 is supplied from hypochlorous acid water generator 30 to mixing bath 92. Therefore, after the hypochlorous acid water has been supplied, electrolytic bath 31 becomes empty, so that generation of the hypochlorous acid water is not started when there is still remaining hypochlorous acid water in electrolytic bath 31. When the entire amount of hypochlorous acid water in electrolytic bath 31 has been supplied, water level sensor 39 outputs a water-shortage signal as the water level information.

Hypochlorous acid water conveyance pump 37 then stops operating, based on a signal from output unit 41*e* having received the information related to the time (the time required for supplying the set amount) from timer 41*c*. As a result, hypochlorous acid water generator 30 is caused to supply a set amount of supply of hypochlorous acid water, from electrolytic bath 31 to air purifier 11 (mixing bath 92).

As described above, air purification control unit 41 executes the process of supplying the hypochlorous acid water from hypochlorous acid water generator 30 (electrolytic bath 31) to air purifier 11. This control by which air purification control unit 41 causes hypochlorous acid water supply unit 36 to supply the hypochlorous acid water every predetermined time period will be referred to as "first control".

<Operation Related to Process of Supplying Water to Air Purifier>

Air purification control unit 41 performs the following process, as the operation related to the process of supplying water to air purifier 11.

Air purification control unit 41 receives water level information (water-shortage signal) from water level sensor 90 in space purification device 10, as a trigger of the process of supplying water to air purifier 11, and outputs a water supply request to water supply unit 50.

Specifically, input unit 41*a* receives water level information (water-shortage signal) from water level sensor 90 in space purification device 10, and outputs the received water level information (water-shortage signal) to processing unit 41*d*.

Processing unit 41*d* identifies control information based on the water level information (water-shortage signal) from input unit 41*a*, the information of the time (time information) from timer 41*c*, and the setting information from storage unit 41*b*, and outputs the identified control information to output unit 41*e*. At this time, the setting information includes information related to on/off operations of electromagnetic valve 51 in water supply unit 50.

Output unit 41*e* then outputs a signal (control signal) to electromagnetic valve 51, based on the received control information.

Electromagnetic valve 51 is caused to operate, based on a signal from output unit 41*e*. Accordingly, water supply unit 50 starts supplying water from an external water feed pipe to air purifier 11 (mixing bath 92), via water delivery pipe 52.

Electromagnetic valve 51 is then stopped, based on a signal from output unit 41*e* having received water level information (water full signal) from water level sensor 90 of space purification device 10. In this manner, water supply unit 50 supplies a set amount of water from an external water feed pipe to air purifier 11 (mixing bath 92).

As described above, air purification control unit 41 causes water supply unit 50 to execute the process of supplying water to air purifier 11. The control by which air purification control unit 41 causes water supply unit 50 to supply water based on the information (water shortage information) of the water level in mixing bath 92 from water level sensor 90 will be referred to as "second control".

<Operation Related to Humidifying Purification Process of Air Purifier>

An operation of air purification control unit 41 performed in relation to the humidifying purification process performed by air purifier 11 will now be explained.

Input unit 41*a* receives user input information from operation device 43, temperature and humidity information of air in indoor space 18 from temperature and humidity sensor 44, and water level information of hypochlorous acid water (mixture water) in mixing bath 92, from water level sensor 90. Input unit 41*a* outputs all of these pieces of received information to processing unit 41*d*.

In this example, operation device 43 is a terminal for entering user input information (such as an air volume, a target temperature, a target humidity, whether the hypochlorous acid is added or not, and a target level of supplied amount of hypochlorous acid) related to space purification device 10, and is communicably connected to air purification control unit 41 wirelessly or over the wire.

Temperature and humidity sensor 44 is a sensor provided in indoor space 18, and senses the temperature and the humidity of the air in indoor space 18.

Storage unit 41*b* stores therein the user input information received by input unit 41*a*, and supply setting information for the operation of supplying the hypochlorous acid to the air being circulated through the device. Storage unit 41*b* outputs the supply setting information being stored to processing unit 41*d*. The supply setting information for the operation of supplying the hypochlorous acid may also be considered as humidification setting information for a humidification and purification operation of air purifier 11.

Timer 41*c* outputs time information related to the current time to processing unit 41*d*.

Processing unit 41*d* receives various types of information (the user input information, the temperature and humidity information, and the water level information) from input unit 41*a*, the time information from timer 41*c*, and the supply setting information from storage unit 41*b*. Processing unit 41*d* identifies control information related to the humidifying purification operation movement, using the received user input information, supply setting information, and time information.

Specifically, processing unit 41*d* identifies a humidification demand amount required in indoor space 18 based on a difference in humidity between the target humidity stored in storage unit 41*b* and the temperature and humidity information of the air in indoor space 18 received from the temperature and humidity sensor 44, at regular time intervals that are based on the time information from timer 41*c*. Based on the identified humidification demand amount, and on the supply setting information stored in storage unit 41*b*, processing unit 41*d* identifies the control information related to the humidifying purification operation movement. Processing unit 41*d* outputs the determined control information to output unit 41*e*.

In addition, when the water level information from water level sensor 90 includes information (water-shortage signal) related to the water level indicating a water shortage of the hypochlorous acid water (mixture water) in mixing bath 92, processing unit 41*d* outputs a signal for requesting for the water supply from water supply unit 50 to output unit 41*e*. Processing unit 41*d* also outputs a signal for requesting the supply of hypochlorous acid water from hypochlorous acid water generator 30 to output unit 41*e* when the operation time of air purifier 11 (humidification motor 11*a*) has reached a predetermined time (e.g., 60 minutes) based on the time information from timer 41*c*. In the present exemplary embodiment, the water level at which the hypochlorous acid water (mixture water) in mixing bath 92 indicates a water shortage is set to a water level where the amount of the hypochlorous acid water has dropped to about ⅓ from the level where hypochlorous acid water (mixture water) in mixing bath 92 is full.

Output unit 41*e* then outputs the received signals to each of air purifier 11, hypochlorous acid water generator 30 (hypochlorous acid water supply unit 36), and water supply unit 50.

Air purifier 11 then receives the signals from output unit 41*e*, and controls the operation based on the received signals. At this time, hypochlorous acid water generator 30 (hypochlorous acid water supply unit 36) receives the signal (the signal for requesting for a supply of hypochlorous acid water) from output unit 41*e*, and performs the operation (first control) related to the process of supplying hypochlorous acid water to air purifier 11 described above, based on the received signal. Water supply unit 50 also receives the signal (signal requesting for a supply of water) from output unit 41*e*, and executes the operation (second control) related to the process of supplying water to air purifier 11 described above, based on the received signal.

As described above, air purification control unit 41 executes each of the first control of causing hypochlorous acid water generator 30 (hypochlorous acid water supply unit 36) to supply hypochlorous acid water at predetermined time intervals, and the second control of causing water supply unit 50 to supply water based on the information (water shortage information) of the water level in mixing bath 92 from water level sensor 90, so as to store the mixture water in mixing bath 92. When the hypochlorous acid water and water are supplied, and the mixture water is stored to and in mixing bath 92, air purification control unit 41 performs a humidifying purification process to the air being circulated through space purification device 10 (air purifier 11) by supplying the hypochlorous acid water (every predetermined time) and the water (every water shortage detection) at cycles different from each other.

<Operation Related to Washing Process after Humidifying Purification Process>

After the humidifying purification process of air purification control unit 41 is finished, the following process is executed as an operation related to a washing process.

Input unit 41*a* receives operation information (signal indicating stop of the operation) of the humidifying purification operation from operation device 43, as a trigger for the washing process (washing mode) following the end of the humidifying purification process. Input unit 41*a* also receives user input information from operation device 43, temperature and humidity information of the air in indoor space 18 from temperature and humidity sensor 44, water level information of water in mixing bath 92 from water level sensor 90, and water level information of water in electrolytic bath 31 from water level sensor 39. Input unit 41*a* outputs each of these pieces of received information to processing unit 41*d*.

Storage unit 41*b* stores therein washing setting information for operations related to the washing process. Storage unit 41*b* then outputs the washing setting information being stored to processing unit 41*d*.

In the example herein, the washing setting information includes setting information related to a first washing operation, and setting information related to a second washing operation. The first washing operation is an operation performed after the humidifying purification operation is finished, of causing water supply unit 50 (electromagnetic valve 33) to supply water to electrolytic bath 31, and of causing hypochlorous acid water supply unit 36 to supply water stored in electrolytic bath 31 to mixing bath 92, without performing the electrolysis. The second washing operation is an operation, performed after the first washing operation is finished, of causing water supply unit 50 (electromagnetic valve 51) to supply water to mixing bath 92, and of performing a humidifying purification operation using the water stored in mixing bath 92. The humidifying purification operation herein may also be said to be a simple humidification operation.

Timer 41*c* outputs time information related to the current time to processing unit 41*d*.

Processing unit 41*d* receives the various types of information from input unit 41*a*, the time information from timer 41*c*, and the washing setting information from storage unit 41*b*. Processing unit 41*d* identifies the control information related to the washing process operation using the received various types of information, time information, and washing setting information.

Output unit 41*e* then outputs signals (control signals) to hypochlorous acid water generator 30 (hypochlorous acid water supply unit 36), air purifier 11, and water supply unit 50, respectively, based on the received control information.

Hypochlorous acid water generator 30, air purifier 11, and water supply unit then receive the corresponding signals from output unit 41*e*, and execute control for the washing process operation (first washing operation), based on the received signals.

Specifically, in the first washing operation, the following process is performed.

To begin with, brine conveyance pump 35 is kept not operating based on the signal from output unit 41*e*, and hypochlorous acid water conveyance pump 37 is kept not operating based on the signal from output unit 41*e*.

Electromagnetic valve 33 is then opened, based on a signal from output unit 41*e*. The tap water from the water pipe then starts being supplied to electrolytic bath 31. Electromagnetic valve 33 is then closed, based on a signal from output unit 41*e* having received the water level information (water full) from water level sensor 39. In this manner, electrolytic bath 31 is filled with tap water with a set amount of supply.

Hypochlorous acid water conveyance pump 37 is then caused to operate, based on a signal from output unit 41*e*. As a result, hypochlorous acid water generator 30 is caused to start supplying the water from electrolytic bath 31 (the water stored in electrolytic bath 31) to air purifier 11 (mixing bath 92). Hypochlorous acid water conveyance pump 37 then stops operating based on a signal from output unit 41*e* having received the information related to the time (the time required to feed the entire amount of water in electrolytic bath 31) from timer 41*c*. As a result, hypochlorous acid water generator 30 supplies the entire amount of water stored in electrolytic bath 31 to mixing bath 92 from electrolytic bath 31.

At this time, the salt derived from the hypochlorous acid water, which is generated by electrolysis of brine, is likely to be deposited and to clog hypochlorous acid water supply unit 36, in particular, hypochlorous acid water conveyance pump 37. However, by performing such a washing process, it is possible to remove the hypochlorous acid water before the deposited salt becomes accumulated inside hypochlorous acid water conveyance pump 37.

In the second washing operation, the following processing is executed, subsequently.

To begin with, water supply unit 50 opens electromagnetic valve 51, based on a signal from output unit 41*e*. Accordingly, water starts being supplied from water delivery pipe 52 to mixing bath 92. Water supply unit 50 then closes electromagnetic valve 51, based on a signal from output unit 41*e* having received the water level information (water full) from water level sensor 90. As a result, mixing bath 92 becomes fully filled with water.

Air purifier 11 then receives a signal from output unit 41*e*, and executes the washing process (humidification operation) for a certain period of time (e.g., 20 minutes), based on the received signal. Note that the humidification operation is preferably performed based on the minimum amount of humidification that can be handled by air purifier 11, not on the humidification amount required in indoor space 18. In this manner, unnecessary humidification of indoor space 18 can be suppressed.

At this time, in air purifier 11, the salt derived from the mixture water is likely to be deposited and to clog eliminator 91 configured by a porous body. However, by performing such a washing process, it is possible to remove the mixture water before the deposited salt becomes accumulated in eliminator 91.

Air purifier 11 then discharges the water stored in mixing bath 92, based on a signal from output unit 41*e*.

As described above, air purification control unit 41 causes the first washing operation to be performed as the washing process of hypochlorous acid water generator 30 (electrolytic bath 31, hypochlorous acid water supply unit 36), and causes the second washing operation to be performed as the washing process of air purifier 11.

Figure 3:
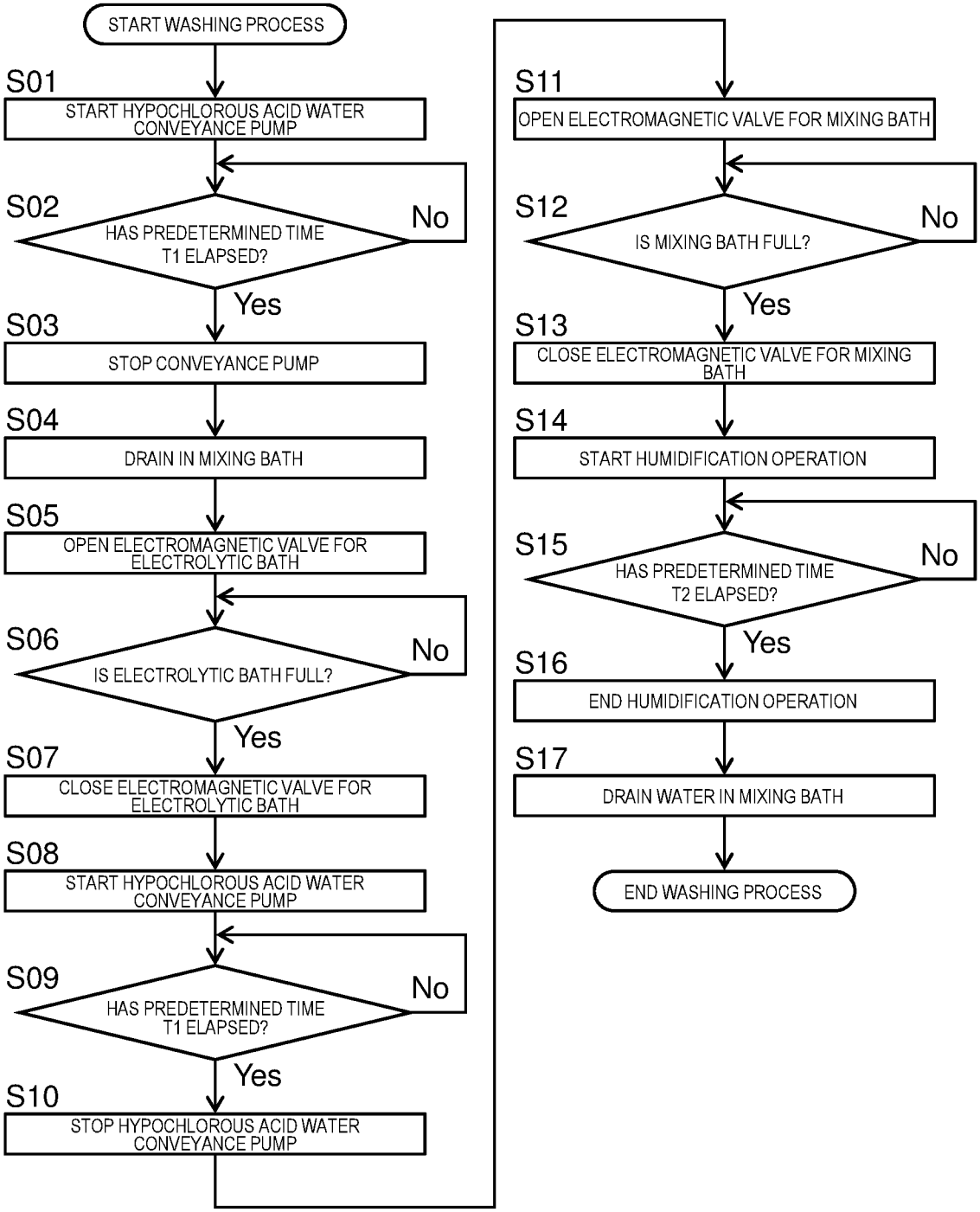
FIG. 3 is a flowchart illustrating the processing sequence of a washing operation performed by the space purification device according to the first exemplary embodiment.

Washing operations in a washing mode of space purification device 10 will now be explained with reference to FIG. 3. FIG. 3 is a flowchart illustrating the processing sequence of a washing process performed by space purification device 10. The washing mode is set to be executed when a predetermined condition is satisfied, and is executed when the humidifying purification operation of air purifier 11 stops, for example.

In the washing mode, as shown in FIG. 3, to begin with, a process for ensuring that electrolytic bath 31 and mixing bath 92 are emptied are performed (steps S01 to S04). Specifically, once the washing process is started, hypochlorous acid water conveyance pump 37 starts operating, to perform the process of feeding the hypochlorous acid water stored in electrolytic bath 31 to mixing bath 92 (step S01). Then, if a predetermined time T1 has elapsed from when hypochlorous acid water conveyance pump 37 has started operating (Yes in step S02), hypochlorous acid water conveyance pump 37 is caused to stop operating, and the process of feeding the hypochlorous acid water in electrolytic bath 31 to mixing bath 92 is ended (step S03). By contrast, if the predetermined time T1 has not elapsed yet (No in step S02), hypochlorous acid water conveyance pump 37 is caused to keep operating as it is (the process returns to step S02). The predetermined time T1 herein is a time (e.g., 30 seconds) required to feed the entire amount of hypochlorous acid water stored in electrolytic bath 31 to mixing bath 92, and is a time estimated in advance through experimental evaluations.

If it has been ensured that electrolytic bath 31 is empty, a process for discharging water in mixing bath 92 is performed for a certain period of time (step S04).

If it has been ensured that mixing bath 92 is empty, electromagnetic valve 33 for electrolytic bath 31 is opened (step S05), to start supplying tap water to electrolytic bath 31 (step S06). If water level sensor 39 detects the water being full (Yes in step S06), electromagnetic valve 33 for electrolytic bath 31 is closed (step S07), and stops supplying water to electrolytic bath 31. If water level sensor 39 does not detect the water being full (No in step S06), the supply of water to electrolytic bath 31 is caused to continue as it is (the process returns to step S06).

If supplying the water to electrolytic bath 31 is finished in step S07, hypochlorous acid water conveyance pump 37 is activated (step S08), and is caused to supply the water in electrolytic bath 31 to mixing bath 92 (step S09). If the predetermined time T1 has elapsed from when the hypochlorous acid water conveyance pump 37 is activated (Yes in step S09), hypochlorous acid water conveyance pump 37 is caused to stop (step S10), and the operation of supplying water from electrolytic bath 31 to mixing bath 92 is caused to end. By contrast, if the predetermined time T1 has not elapsed yet (No in step S09), the water supplying operation of hypochlorous acid water conveyance pump 37 is caused to continue as it is (the process returns to step S09).

The series of operations from step S05 to step S10 described above correspond to the first washing operation. In the first washing operation, by supplying only water to hypochlorous acid water generator 30, and then conveying the water to mixing bath 92, the water is circulated through hypochlorous acid water generator 30 and hypochlorous acid water supply unit 36. As a result, the hypochlorous acid water attached on the internal of each member is washed away with the water.

Subsequently, if it has been ensured that electrolytic bath 31 is empty, electromagnetic valve 51 for mixing bath 92 is opened (step S11), and supplying water into mixing bath 92 is caused to start (step S12). If water level sensor 90 detects that mixing bath 92 is full (Yes in step S12), electromagnetic valve 51 for mixing bath 92 is closed (step S13), and supplying water to mixing bath 92 is caused to stop. By contrast, if water level sensor 90 has not detected that mixing bath 92 is full (No in step S09), supplying the water to the mixing bath 92 is caused to keep as it is (the process returns to step S09).

If supplying the water to mixing bath 92 is finished in step S09, air purifier 11 rotates humidification motor 11*a* and starts the humidification operation (step S14). If a predetermined time T2 has elapsed from when the humidification operation is started (Yes in step S15), air purifier 11 is caused to stop the operation, and is caused to end the humidification operation (step S16). By contrast, if the predetermined time T2 has not elapsed yet (No in step S15), air purifier 11 is caused to continue the humidification operation as it is (the process returns to step S15). The predetermined time T2 herein is a time required for the water to be sufficiently supplied through air purifier 11 (e.g., 20 minutes), and is a time estimated in advance through experimental evaluations.

Once air purifier 11 ends the humidification operation, the water in mixing bath 92 is drained (step S17).

The series of operations from step S11 to step S17 described above correspond to the second washing operation. In the second washing operation, water is supplied to mixing bath 92, and the humidification operation is performed using the water stored in mixing bath 92. In this manner, the water is circulated through air purifier 11. Therefore, the hypochlorous acid water attached on the internal of each member is washed away with the water. In other words, the washing process (process of removing the hypochlorous acid water) the internal of air purifier 11 is performed.

The washing process is completed through the sequence of the processes described above, and air purification control unit 41 goes back to the humidifying purification operation. In other words, air purification control unit 41 causes hypochlorous acid water generator 30 and space purification device 10 to execute the processing operation again, based on user input information from operation device 43.

As described above, with space purification device 10 according to the first exemplary embodiment, the following advantageous effects can be achieved.

(1) The space purification device 10 includes: hypochlorous acid water generator 30 including (i) electrolytic bath 31 that stores a sodium chloride solution, and (ii) electrode 32 that is energized to electrolyze the sodium chloride solution to generate hypochlorous acid water; mixing bath 92 storing mixture water of the hypochlorous acid water and water; hypochlorous acid water supply unit 36 supplying the hypochlorous acid water from hypochlorous acid water generator 30 to mixing bath 92; water supply unit 50 supplying the water to electrolytic bath 31 or to mixing bath 92; air purifier 11 that micronizes the mixture water and to release the mixture water micronized into air, by performing a humidifying purification operation using the mixture water stored in mixing bath 92; and air purification control unit 41 controlling hypochlorous acid water generator 30, hypochlorous acid water supply unit 36, water supply unit 50, and air purifier 11. Air purification control unit 41 is then configured to, after the humidifying purification operation using the mixture water has finished, perform the first washing operation (a series of operations from step S05 to step S10) of causing water supply unit 50 to supply water to electrolytic bath 31 and causing hypochlorous acid water supply unit 36 to supply the water stored in electrolytic bath 31 to mixing bath 92 without performing the electrolyzing.

As a result, in the first washing operation, the members including the circulation passage extending from electrolytic bath 31 to mixing bath 92 are washed with the water stored in electrolytic bath 31, and the deposited component (e.g., sodium chloride or the like) derived from the hypochlorous acid water can be removed. Therefore, in space purification device 10, even when the device is used continuously over a long time period, it is possible to suppress clogging inside of the device.

(2) In space purification device 10, air purification control unit 41 is configured, after the first washing operation has finished, to perform a second washing operation (a series of operations from step S11 to step S17) of causing water supply unit 50 to supply the water to mixing bath 92, and performing the humidifying purification operation using the water stored in mixing bath 92. As a result, in the second washing operation, inside of air purifier 11 (e.g., eliminator 91) is washed with the water stored in mixing bath 92, and the deposited component (e.g., sodium chloride) derived from the hypochlorous acid water can be removed. Therefore, in space purification device 10, it is possible to suppress clogging inside of the device more, even when the device is used continuously over a long time period.

The present disclosure has been described above based on the exemplary embodiments. It will be understood by those skilled in the art that the exemplary embodiments are merely examples, that the components or the processes disclosed in the exemplary embodiments may be combined as various modifications, and that such modifications also fall within the scope of the present disclosure.

In space purification device 10 according to first exemplary embodiment, each of the washing operations (first washing operation, second washing operation) has been explained to be performed as the washing process when operation information (operation stop signal) of the humidifying purification operation is received from operation device 43, but the present invention is not limited thereto. For example, air purifier 11 may be caused to stop the humidifying purification operation and execute the washing operation when the humidifying purification operation is continued for a certain period of time (e.g., when 24 hours have elapsed). In this manner, the washing operation (the first washing operation or the second washing operation) is performed regularly, so that the clogging inside of the device can be suppressed reliably, even when the device is used continuously over a long time period.

In addition, in space purification device 10 according to the first exemplary embodiment, air purification control unit 41 may be configured to, after supplying the hypochlorous acid water from electrolytic bath 31 to mixing bath 92 is finished, control water supply unit 50 to supply the water from the water supply unit 50 to electrolytic bath 31 to store the water in electrolytic bath 31 in advance, in the first washing operation. In other words, in such a first washing operation, immediately after hypochlorous acid water supply unit 36 supplies the hypochlorous acid water from electrolytic bath 31 to mixing bath 92, electrolytic bath 31 is filled with water and kept standby. The subsequent process is then performed when the humidifying purification operation is stopped. In this manner, in electrolytic bath 31, once supplying hypochlorous acid water from electrolytic bath 31 to mixing bath 92 is finished, electrode 32 of electrolytic bath 31 is kept immersed in the water. Therefore, it is possible to inhibit a local corrosion of a part of electrolytic bath 31 including electrode 32, caused by concentration of the component included in the hypochlorous acid water, which takes place as the hypochlorous acid water becomes dry while electrolytic bath 31 is left empty, with the hypochlorous acid water slightly remaining on the surface of such a part of electrolytic bath 31 including electrode 32.

Furthermore, in space purification device 10 according to the first exemplary embodiment, it has been explained that the first washing operation and the second washing operation are performed continuously as a washing process, but the present invention is not limited thereto. For example, the first washing operation and the second washing operation may be performed independently from each other, or may be performed at predetermined timings different from each other. Even with such configurations, the advantageous effects described above can still be achieved.

Furthermore, in space purification device 10 according to the first exemplary embodiment, the first washing operation has been explained to be performed when the humidifying purification operation is stopped, but the present invention is not limited thereto. For example, the first washing operation may be performed during the humidifying purification operation. In this manner, it is possible to use the water generated by the first washing operation (water passed through electrolytic bath 31 or the like) as water for diluting the hypochlorous acid water in mixing bath 92. In addition, because electrolytic bath 31 is washed every time, the electrolytic component such as sodium chloride in electrolytic bath 31 is washed away. Therefore, it is possible to stabilize the concentration of hypochlorous acid water generated by the electrolysis.

INDUSTRIAL APPLICABILITY

The space purification device according to the present disclosure micronizes hypochlorous acid water and releases the water into the air, and is useful as a device for sterilizing or deodorizing the air in a target space.

REFERENCE MARKS IN THE DRAWINGS

2 air inlet
3 air outlet
4 prior stage air passage
5 middle stage air passage
6 subsequent stage air passage
8 air
9 air
10 space purification device
11 air purifier
11*a* humidification motor
11*b* humidification nozzle
13 air blower
14 refrigeration coil
15 air conditioner
16 duct
16*a* indoor air inlet
17 duct
17*a* indoor air outlet
18 indoor space
20 outdoor unit
20*a* compressor
20*b* expander
20*c* outdoor heat exchanger
20*d* blower fan
20*e* four-way valve
21 refrigerant circuit
24 duct
30 hypochlorous acid water generator
31 electrolytic bath
32 electrode
33 electromagnetic valve
34 brine tank
35 brine conveyance pump
36 hypochlorous acid water supply unit
37 hypochlorous acid water conveyance pump
38 water delivery pipe
39 water level sensor
41 air purification control unit
41*a* input unit
41*b* storage unit
41*c* timer
41*d* processing unit
41*e* output unit
42 air conditioning control unit
43 operation device
44 temperature and humidity sensor
50 water supply unit
51 electromagnetic valve
52 water delivery pipe
90 water level sensor
91 eliminator
92 mixing bath
100 space purification system

The invention claimed is:

1. A space purification device comprising:

a hypochlorous acid water generator including (i) an electrolytic bath that stores a sodium chloride solution, and (ii) an electrode that is energized to electrolyze the sodium chloride solution to generate hypochlorous acid water;

a mixing bath storing mixture water of the hypochlorous acid water and water;

a hypochlorous acid water supply unit supplying the hypochlorous acid water from the hypochlorous acid water generator to the mixing bath;

a water supply unit supplying the water to the electrolytic bath or to the mixing bath;

a humidifying purification unit that micronizes the mixture water and to release the mixture water micronized into air, by performing a humidifying purification operation using the mixture water stored in the mixing bath; and a control unit controlling the hypochlorous acid water generator, the hypochlorous acid water supply unit, the water supply unit, and the humidifying purification unit, wherein the control unit is configured to, after the humidifying purification operation using the mixture water has finished, perform a first washing operation of causing the water supply unit to supply the water to the electrolytic bath and causing the hypochlorous acid water supply unit to supply the water stored in the electrolytic bath to the mixing bath without performing the electrolyzing, wherein the control unit is configured to cause the water supply unit to supply the water to the mixing bath after the first washing operation has finished, and to perform a second washing operation of performing the humidifying purification operation using the water stored in the mixing bath.

2. The space purification device according to claim 1, wherein the control unit is configured to, after the hypochlorous acid water generator has finished supplying the hypochlorous acid water to the mixing bath, control the water supply unit to supply the water to the electrolytic bath, and to store the water in the electrolytic bath in advance, in the first washing operation.

3. The space purification device according to claim 1, wherein the control unit is configured to end the humidifying purification operation every time a predetermined period elapses.

4. The space purification device according to claim 1, wherein the control unit is configured to end the humidifying purification operation every time a predetermined period elapses.

* * * * *